US005882227A

United States Patent [19]

Neidich

[11] Patent Number: 5,882,227

[45] Date of Patent: Mar. 16, 1999

[54] CONTROLLED IMPEDANCE CONNECTOR BLOCK

[75] Inventor: Douglas A. Neidich, Harrisburg, Pa.

[73] Assignee: Intercon Systems, Inc., Middletown, Pa.

[21] Appl. No.: 932,313

[22] Filed: Sep. 17, 1997

[51] Int. Cl.[6] ..... H01R 13/648

[52] U.S. Cl. ..... 439/608; 439/372

[58] Field of Search ..... 439/157, 159, 439/358, 372, 607, 608

[56] References Cited

U.S. PATENT DOCUMENTS

| | | | |
|---|---|---|---|
| 2,952,828 | 9/1960 | Dorizzi . | |
| 3,231,663 | 1/1966 | Schwartz | 174/35 |
| 3,246,208 | 4/1966 | Lex, Jr. et al. | 317/101 |
| 3,264,526 | 8/1966 | Wiggerman | 317/101 |
| 3,406,369 | 10/1968 | Taylor, Jr. . | |
| 3,430,183 | 2/1969 | Feeser et al. . | |
| 3,432,801 | 3/1969 | Ruotolo . | |
| 3,434,094 | 3/1969 | Walter . | |
| 3,448,345 | 6/1969 | Koehler, Jr. et al. | 317/101 |
| 3,476,258 | 11/1969 | Dorsett | 211/41 |
| 3,587,028 | 6/1971 | Uberbacher . | |
| 3,634,814 | 1/1972 | Inacker . | |
| 3,643,201 | 2/1972 | Harwood . | |
| 3,651,432 | 3/1972 | Henschen et al. | 333/33 |
| 3,689,865 | 9/1972 | Pierini et al. . | |
| 3,767,974 | 10/1973 | Donovan, Jr. et al. | 317/101 |
| 3,871,728 | 3/1975 | Goodman . | |
| 3,902,777 | 9/1975 | Anhalt et al. . | |
| 4,064,551 | 12/1977 | Lightfoot | 361/399 |
| 4,070,081 | 1/1978 | Takahashi . | |
| 4,070,084 | 1/1978 | Hutchison . | |
| 4,232,929 | 11/1980 | Zobawa . | |
| 4,241,966 | 12/1980 | Gomez . | |
| 4,331,370 | 5/1982 | Andrews et al. . | |
| 4,341,428 | 7/1982 | Hatch et al. . | |
| 4,386,814 | 6/1983 | Asick . | |
| 4,403,102 | 9/1983 | Jordan et al. | 174/15 |
| 4,406,512 | 9/1983 | Schell . | |
| 4,410,222 | 10/1983 | Enomoto et al. . | |
| 4,418,972 | 12/1983 | Benasutti . | |
| 4,433,886 | 2/1984 | Cassarly et al. . | |
| 4,447,101 | 5/1984 | Gugliotti . | |
| 4,451,107 | 5/1984 | Dola et al. . | |
| 4,537,454 | 8/1985 | Douty et al. . | |
| 4,579,408 | 4/1986 | Sasaki . | |
| 4,582,386 | 4/1986 | Martens . | |
| 4,601,527 | 7/1986 | Lemke . | |
| 4,602,831 | 7/1986 | Lockard . | |
| 4,616,893 | 10/1986 | Feldman . | |
| 4,640,565 | 2/1987 | Hasircoglu . | |
| 4,655,518 | 4/1987 | Johnson et al. . | |
| 4,695,106 | 9/1987 | Feldman et al. | 439/83 |
| 4,734,058 | 3/1988 | Pavlacka | 439/607 |
| 4,737,116 | 4/1988 | Slye et al. | 439/92 |
| 4,761,141 | 8/1988 | Hawk et al. | 439/153 |
| 4,762,500 | 8/1988 | Dola et al. | 439/79 |
| 4,791,391 | 12/1988 | Linnell et al. | 333/184 |
| 4,806,107 | 2/1989 | Arnold et al. | 439/79 |
| 4,806,124 | 2/1989 | Bowlin | 439/607 |
| 4,824,377 | 4/1989 | De Burro | 439/186 |

(List continued on next page.)

FOREIGN PATENT DOCUMENTS

| | | |
|---|---|---|
| 81 22354 | 6/1983 | France . |
| 60-68570 | 4/1985 | Japan . |
| 87/00741 | 9/1987 | WIPO . |

OTHER PUBLICATIONS

"Circuit Board Attachment", Andreini et al., T876,004,7/28/70, abstract and two sheets of figures.

Technical Bulletin No. 237, Teradyne Connection Systems, Inc., issue date Jan. 29, 1985, two pages.

*Primary Examiner*—Khiem Nguyen

*Attorney, Agent, or Firm*—Thomas Hooker, P.C.

[57] ABSTRACT

A controlled impedance block for connecting signal lines on a flexible cable to components on a circuit board includes a ground plane matrix surrounding adjacent signal lines. The matrix is formed from intersecting sets of ground blades with electrical connections between the blades at intersections and electrical connections with ground contact pins at intersections.

20 Claims, 11 Drawing Sheets

U.S. PATENT DOCUMENTS

| | | | |
|---|---|---|---|
| 4,875,865 | 10/1989 | Demler, Jr. et al. | 439/101 |
| 4,881,904 | 11/1989 | Ammon et al. | 439/78 |
| 4,881,905 | 11/1989 | Demler, Jr. et al. | 439/79 |
| 4,932,888 | 6/1990 | Senor | 439/108 |
| 4,941,833 | 7/1990 | Noschese et al. | 439/92 |
| 4,950,172 | 8/1990 | Anhalt et al. | 439/108 |
| 4,964,814 | 10/1990 | Tengler et al. | 439/607 |
| 4,973,260 | 11/1990 | Madore et al. | 439/101 |
| 4,975,069 | 12/1990 | Fedder et al. | 439/101 |
| 4,976,628 | 12/1990 | Fedder | 439/101 |
| 5,004,427 | 4/1991 | Lindeman | 439/101 |
| 5,017,149 | 5/1991 | Hatanaka | 439/157 |
| 5,035,632 | 7/1991 | Rudoy et al. | 439/108 |
| 5,102,354 | 4/1992 | Crane et al. | 439/620 |
| 5,108,298 | 4/1992 | Simmel | 439/157 |
| 5,114,355 | 5/1992 | Kimmel et al. | 439/101 |
| 5,156,554 | 10/1992 | Rudoy et al. | 439/108 |
| 5,160,273 | 11/1992 | Carney | 439/108 |
| 5,161,987 | 11/1992 | Sinisi | 439/101 |
| 5,169,324 | 12/1992 | Lemke et al. | 439/101 |
| 5,169,343 | 12/1992 | Andrews | 439/608 |
| 5,175,928 | 1/1993 | Grabbe | 29/884 |
| 5,183,405 | 2/1993 | Elicker et al. | 439/108 |
| 5,195,899 | 3/1993 | Yatsu et al. | 439/101 |
| 5,201,855 | 4/1993 | Ikola | 439/608 |
| 5,208,942 | 5/1993 | Simon | 16/115 |
| 5,219,459 | 6/1993 | Kaneko | 439/157 |
| 5,232,374 | 8/1993 | Iino | 439/157 |
| 5,238,414 | 8/1993 | Yaegashi et al. | 439/108 |
| 5,256,074 | 10/1993 | Tan et al. | 439/108 |
| 5,267,875 | 12/1993 | Koegel et al. | 439/497 |
| 5,269,703 | 12/1993 | Ikegami | 439/607 |
| 5,293,303 | 3/1994 | Fletcher et al. | 361/798 |
| 5,331,505 | 7/1994 | Wilheim | 361/306.3 |
| 5,332,330 | 7/1994 | Kaneko | 403/321 |
| 5,348,489 | 9/1994 | Yeh | 439/153 |
| 5,364,282 | 11/1994 | Tondreault | 439/157 |
| 5,376,009 | 12/1994 | Olsson et al. | 439/67 |
| 5,386,346 | 1/1995 | Gleadall | 361/799 |
| 5,389,000 | 2/1995 | DiViesti et al. | 439/157 |
| 5,417,578 | 5/1995 | Mroczkowski et al. | 439/101 |
| 5,441,425 | 8/1995 | Kitamura | 439/620 |
| 5,443,394 | 8/1995 | Billman et al. | 439/157 |
| 5,469,336 | 11/1995 | Soulard | 361/818 |
| 5,470,240 | 11/1995 | Suzuki | 439/157 |
| 5,493,259 | 2/1996 | Blalock et al. | 333/182 |
| 5,516,294 | 5/1996 | Andrews et al. | 439/63 |
| 5,518,422 | 5/1996 | Zell et al. | 439/608 |
| 5,520,554 | 5/1996 | Henningsson et al. | 439/607 |
| 5,525,066 | 10/1996 | Morlion et al. | 439/608 X |
| 5,542,854 | 8/1996 | Bowen | 439/157 |
| 5,558,528 | 9/1996 | Cheng et al. | 439/160 |
| 5,577,922 | 11/1996 | Enomoto et al. | 439/157 |
| 5,584,705 | 12/1996 | Lin | 439/157 |
| 5,586,912 | 12/1996 | Eslampour et al. | 439/620 |

CONTROLLED IMPEDANCE CONNECTOR BLOCK

FIELD OF THE INVENTION

The invention relates to controlled impedance connector blocks, particularly blocks of the type used for high frequency signal transmission between a flexible cable and a circuit board.

DESCRIPTION OF THE PRIOR ART

Modern electronic systems include circuit boards connected together by flat flexible cables with a large number of parallel signal conductors or lines extending along the lengths of the cables for establishing electrical connections between circuit elements on the spaced boards.

Electronic components have, in time, increased greatly in speed, requiring transmission of high frequency signals along flexible cables. The increased transmission frequency can lead to undesired inductive coupling between adjacent signal lines. In order to reduce inductive coupling, flexible cables conventionally include ground lines spaced between adjacent signal lines. All the ground lines are connected to ground and form an effective shield between adjacent signal lines, permitting high frequency signal transmission.

In order to prevent inductive coupling between adjacent signal lines extending between electronic components it is necessary to provide shielding between the signal lines at the connector block used to form electrical connections between the signal lines in the flexible cable and circuitry on the circuit board. Conventionally, these connections are made using a matable connector block having a base housing permanently mounted on the circuit board and a header housing mounted on one end of the flexible cable. The base housing includes a densely spaced array of signal contact pins, conventionally arranged in spaced parallel rows extending along the length of the base, which extend into holes in the circuit board to form electrical connections with components on the board. The header housing conventionally includes a plurality of terminals which are joined to the signal conductors in the flexible cable and which mate, or form electrical connections, with the pins in the base housing. Conventionally, the terminals in the header housing are arranged in closely spaced parallel rows in the same pattern as the pins in the base housing.

It is recognized that shielding is required in the connector blocks used to join flexible cables to circuit boards in order to prevent inductive coupling of high frequency signals. Various approaches have been used in an attempt to provide effective shielding, including providing a ground plane matrix of intersection plates at ground potential. The matrix surrounds each signal line extending between the cable and the circuit board. In some connector blocks, one set of parallel plates in the matrix is permanently located in one housing and the other set of intersecting parallel plates is permanently located in the other housing so that the matrix is formed upon assembly or mating of the blocks. Considerable force is required to mate the housings and simultaneously form electrical connections for all of the signal and ground connections.

In other blocks the matrix is permanently mounted in one of the two housings forming the connector block and surrounds each signal terminal or pin. During mating of these blocks, electrical connections are formed between signal terminals and connections are also formed between the ground plane lines in the flexible cable and ground components in the circuit board. Considerable force is required to mate the housings.

The need to provide effective ground plane shielding between adjacent signal lines passing through connector blocks is further complicated by the requirement that electronic components, including connector blocks, occupy minimum space, necessitating location of signal and ground lines close to each other. There is limited space available to position the ground blades required for shielding between the closely spaced signal lines.

SUMMARY OF THE INVENTION

The invention is a high density connector block particularly useful in forming controlled impedance electrical connections between signal lines in a flexible cable and components on a circuit board. The connector block includes a base housing mounted on the circuit board with high density alternate rows of signal contact pins and ground contact pins. The ground pins are located between and shield adjacent signal pins.

The base housing mates with a header housing mounted on the end of a flexible cable of the type having closely spaced signal lines with ground lines between adjacent signal lines. The signal lines are connected to spaced rows of disconnect terminals in the header housing. All of the ground lines are connected to a ground plane matrix confined in the header housing and surrounding adjacent signal terminals.

The ground plane matrix is formed from intersecting sets of parallel ground blades and is maintained at ground potential. The ground plane blades are formed from thin strip metal stock and occupy minimum space in the header housing, permitting location of the signal disconnect terminals in the housing in a very dense array. The blades are in electrical connection with each other at points of intersection in the matrix to assure that the entire matrix is maintained at a ground potential for effective shielding. A plurality of ground contact tails extend upwardly from one set of ground blades in the matrix between the tails extending up from disconnect terminals. The ground tails and disconnect tails are electrically connected to the ground lines and signal lines, respectively, in the flexible cable.

The matrix includes pairs of cantilever contact arms located at points of intersection for establishing ground electrical connections with the ground contact pins when the header housing is mated with the base housing. The plural ground connections assure ground continuity from the individual ground lines in the flexible cable through the mated connector block to the individual ground contact pins and to the ground circuitry in the circuit board. The contact arms are located in the thickness of the blades and do not occupy valuable space in the header housing.

The controlled impedance connector block forms a large number of signal and ground electrical connections between a flexible cable and circuit board. The total force required to insert a large number of signal and ground pins into disconnect terminals and the ground matrix is considerable. The connector block includes improved mating and disengaging arms on the ends of the base housing to facilitate insertion. The arms are manually rotated over the ends of the header housing during mating. Rollers on the arms engage convex cam surfaces on the ends of the top of the header housing. The slopes of the surfaces decrease during mating permitting mating by applying a relatively constant torque to the arms and initially relatively rapidly moving the header housing toward the base and then, during final mating, relatively slowly moving the header housing into the base as the signal and ground pins are moved into electrical connections with the disconnect terminals and ground matrix, respectively, and the insertion force increases.

Other objects and features of the invention will become apparent as the description proceeds, especially when taken in conjunction with the accompanying drawings illustrating the invention, of which there are 10 sheets and one embodiment.

DESCRIPTION OF THE PREFERRED EMBODIMENT

Figure 1:
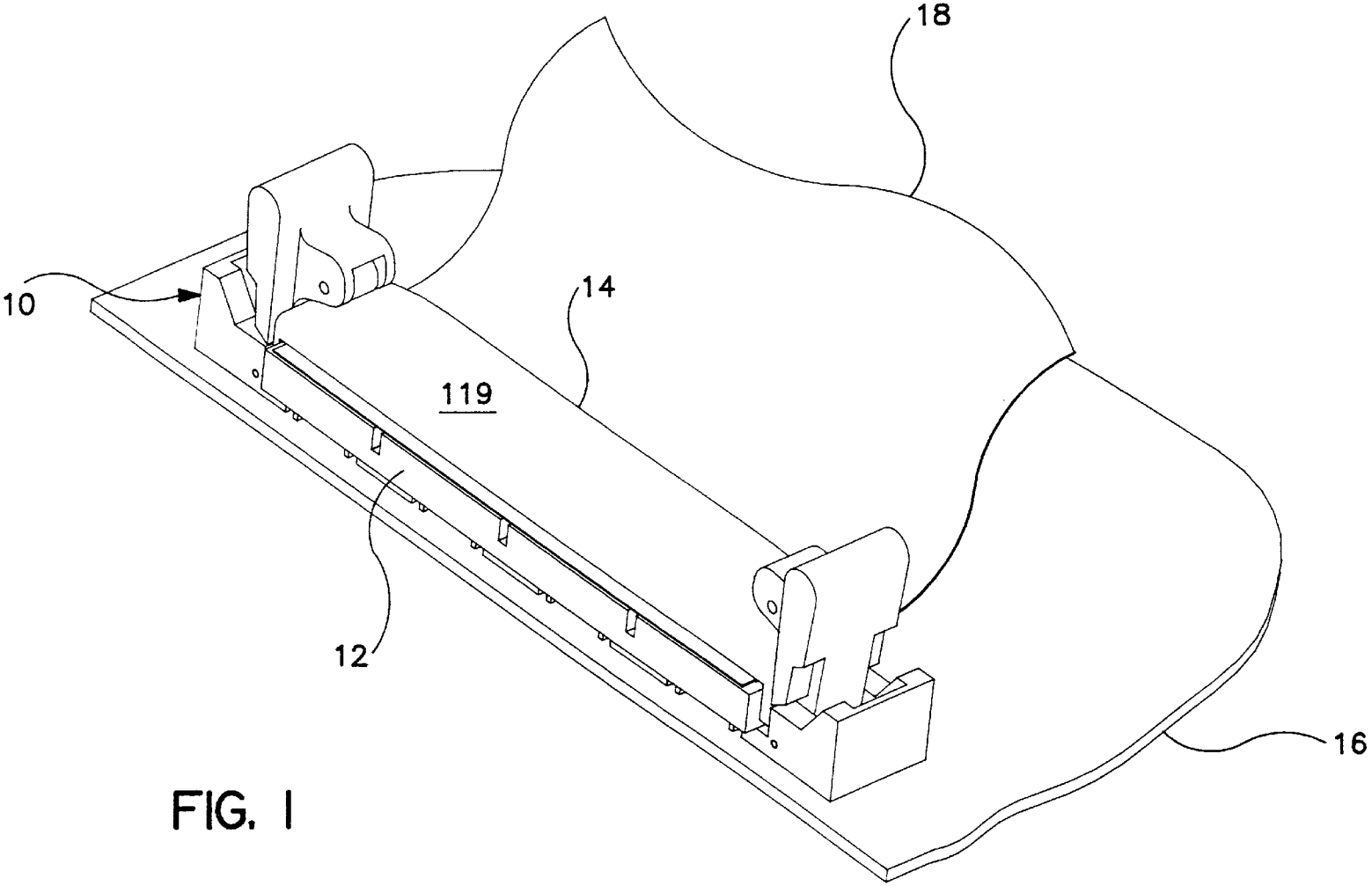
FIG. 1 is a perspective view of a connector block according to the invention.
Figure 2:
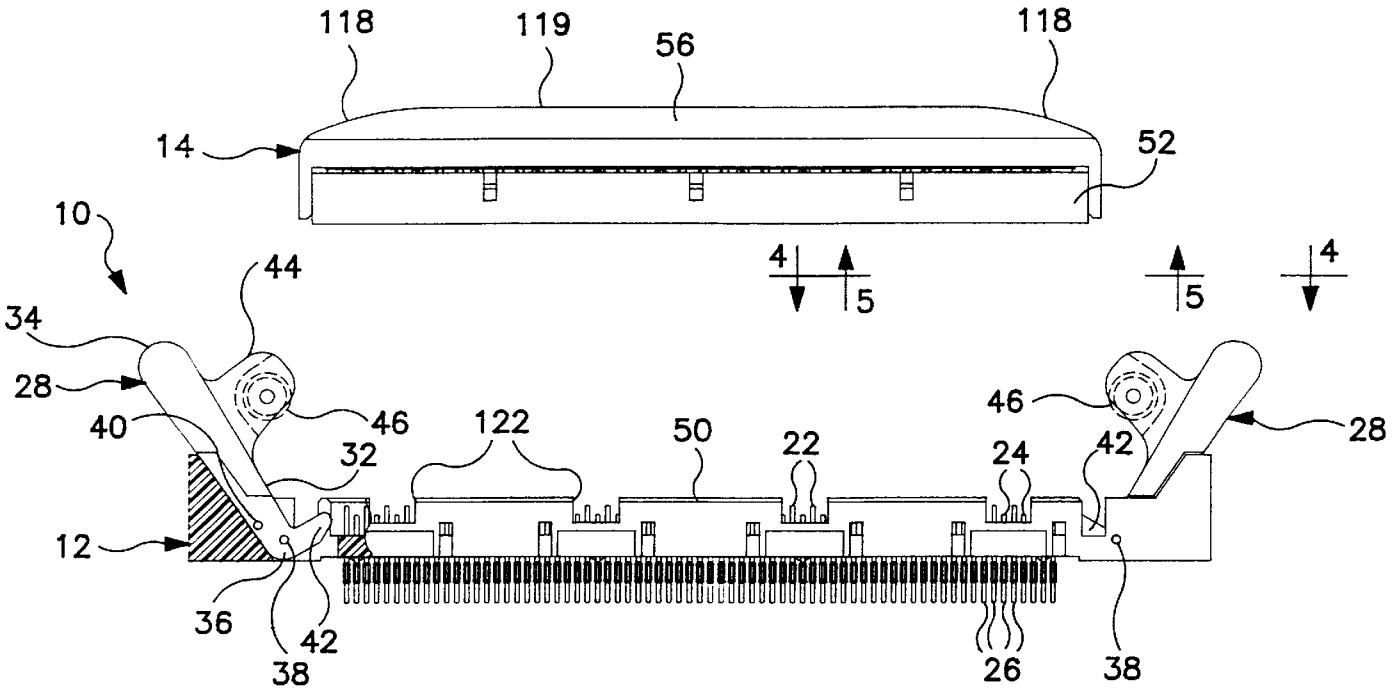
FIGS. 2 and 3 are partially broken away side views illustrating the header and base housings prior to and following meeting.
Figure 3:
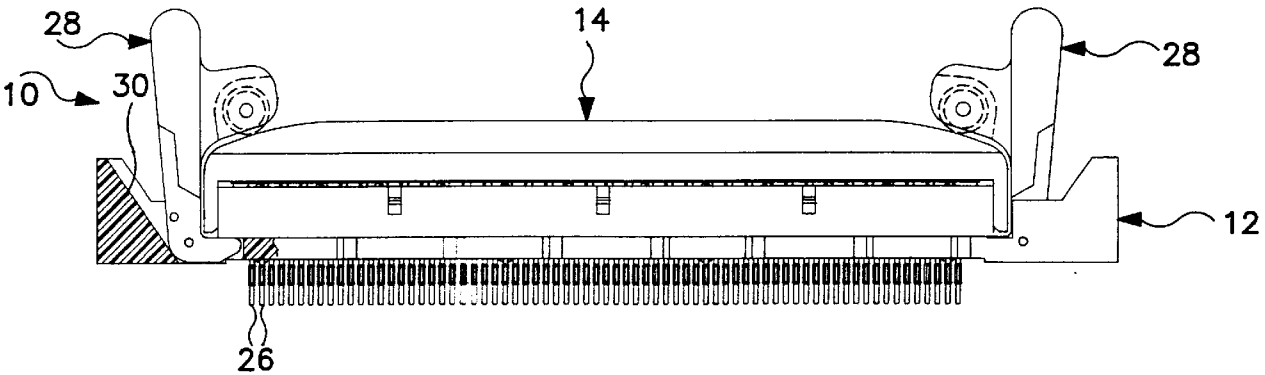

Controlled impedance connector block 10 includes matable base contact housing 12 and header contact housing 14. FIG. 2 illustrates the two housing prior to mating. FIG. 3 illustrates the housing when mated. The base contact housing 12 is mounted on a conventional circuit board 16. The header contact housing is mounted on one end of flexible cable 18. The cable is conventional in design and includes a plurality of elongate conductors spaced across the width of the cable. Ground conductors are located between signal conductors in order to control the impedance between conductors and permit high frequency signal transmission.

Figure 4:
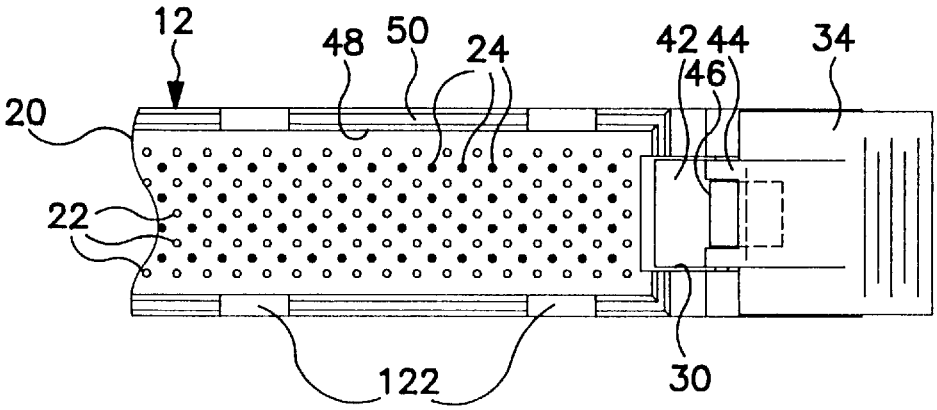
FIGS. 4 and 5 are views taken along lines 4—4 and 5—5 respectively of FIG. 2.
Figure 10:
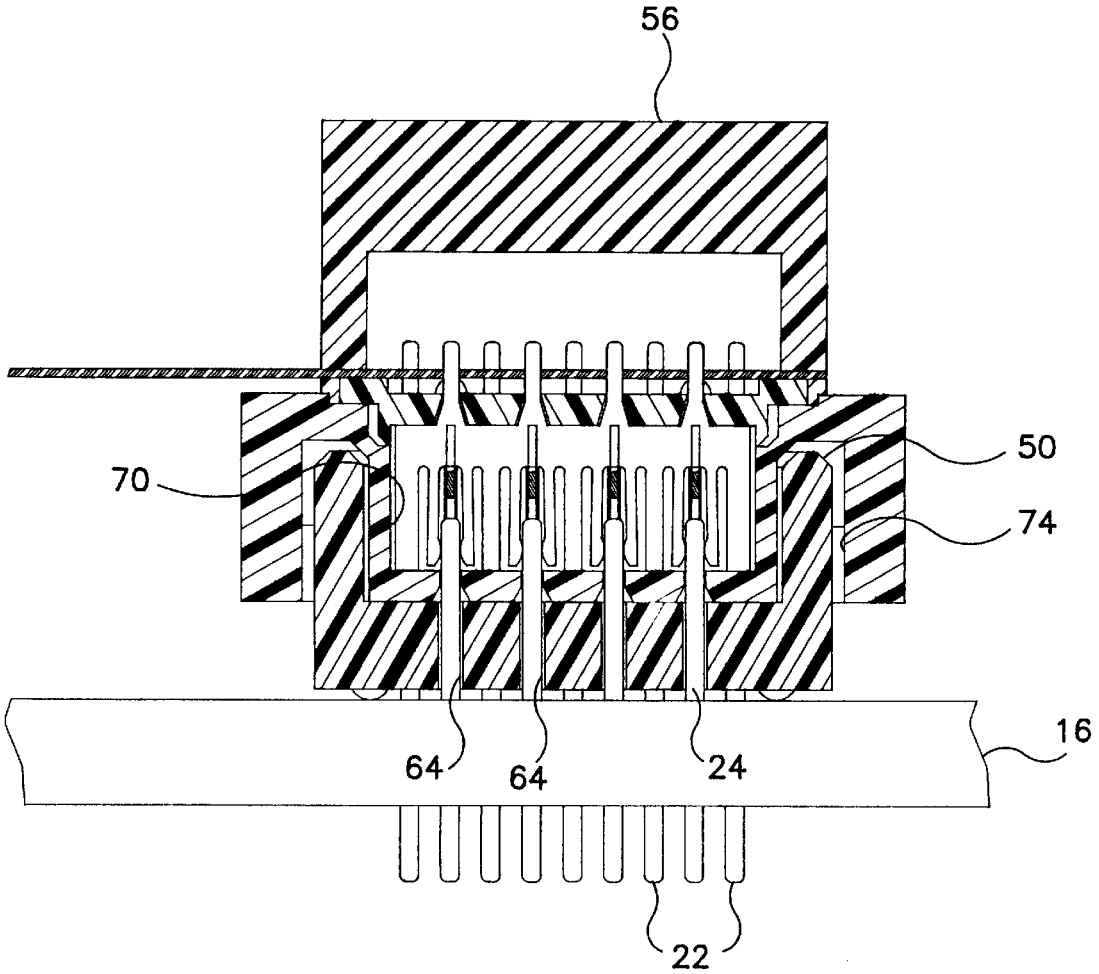
FIGS. 10 and 11 are sectional views through the mated block.
Figure 11:
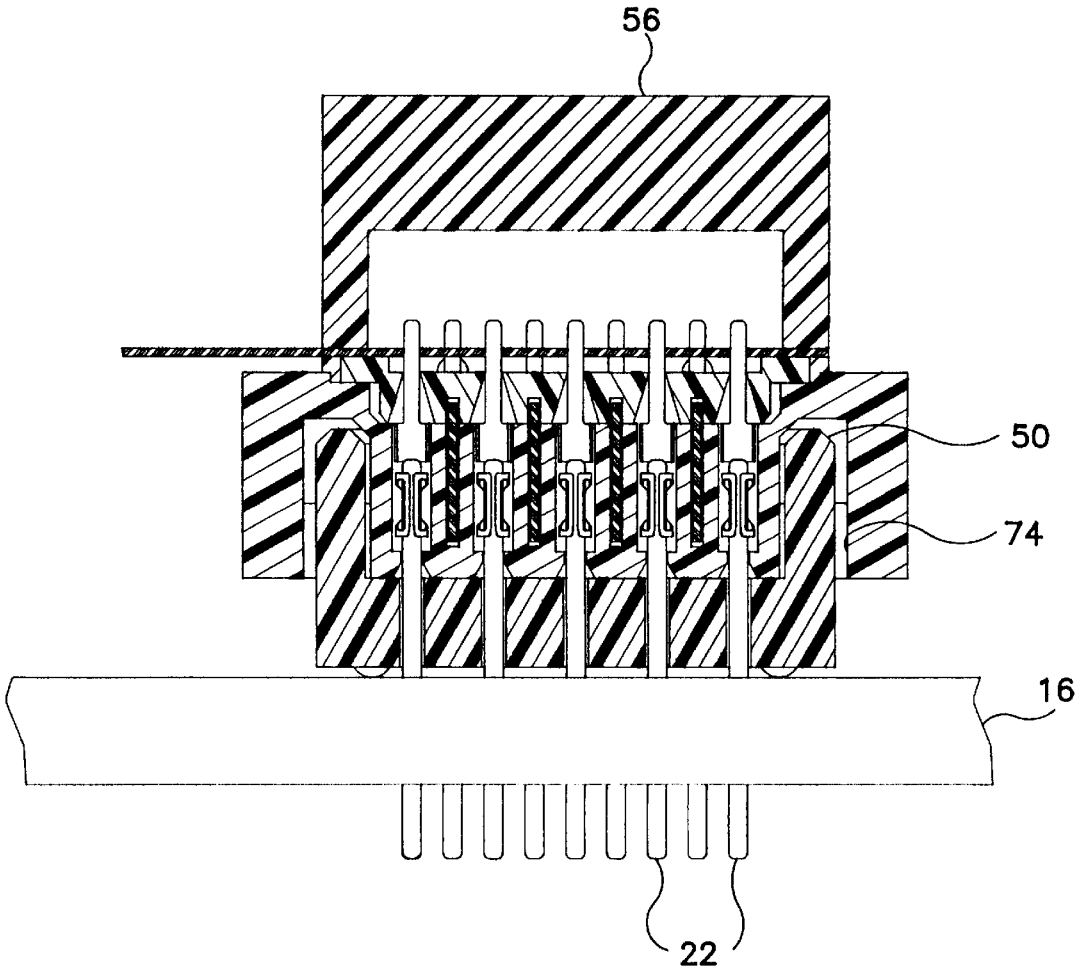

Base contact housing 12 includes an elongate molded plastic insulating body 20 with elongate rows of signal contact pins 22 and ground contact pins 24 extending above and below the body 20. The upper ends of the pins are shown in FIG. 4 with the signal contact pins shown as circles and the ground contact pins shown in solid. The upper ends of the signal contact pins 22 extend above the upper ends of the ground contact pins 24 as shown in FIG. 2 and FIGS. 10 and 11. Like contact tails 26 are formed on the lower ends of pins 22 and 24 to facilitate forming electrical connections between the pins and circuitry in board 16. As illustrated in FIG. 4, rows of ground pins 24 are located between adjacent rows of signal pins 22. Each ground pin is equidistant from four adjacent signal pins.

Two like header housing mating and ejection arms 28 are mounted on the opposing ends of body 20. Each arm 28 is located in an inwardly facing recess 30 at an end of the body. The arms are preferably molded from plastic and each include an elongate lever 32 with wide outer end 34 having the same width as the width of body 20, as shown in FIG. 4, and a narrow inner end 36 located in a recess 30. The arm is rotatably secured to body 20 by hinge pin 38 which extends through the inner end of the arm and into the body to either side of the arm. A pair of detents 40 (only one of which is illustrated) are provided on opposing sides of the inner arm end 36. Detents 40 frictionally engage the sides of the recess 30 and hold the arms 28 in the open positions as shown in FIG. 2. Ejection finger 42 extends perpendicularly away from the inner end of lever 32 toward the upper ends of pins 22 and 24. The free end of the finger forms a lift surface for engaging the header housing during unmating from the base contact housing.

An inwardly facing mounting protuberance 44 is provided on lever 32 a distance above the hinge pin 38. Metal closing roller 46 is mounted in a recess in protuberance 44, preferably using a low friction ball bearing, with the roller exposed below the projection 44 and facing downwardly. The upper ends of pins 22 and 24 are located in recess 48 defined by circumferential wall 50 extending around body 20. Openings are provided in the ends of the wall 50 to permit rotation of fingers 42.

Header contact housing 14 includes a body 52, a spacer plate 54 located above the body and a stress relief cover 56 mounted on the body. The cover holds the end of the flexible cable 18 to the housing. The body 52, plate 54 and cover 56 are molded from plastic insulating material.

Figure 6:
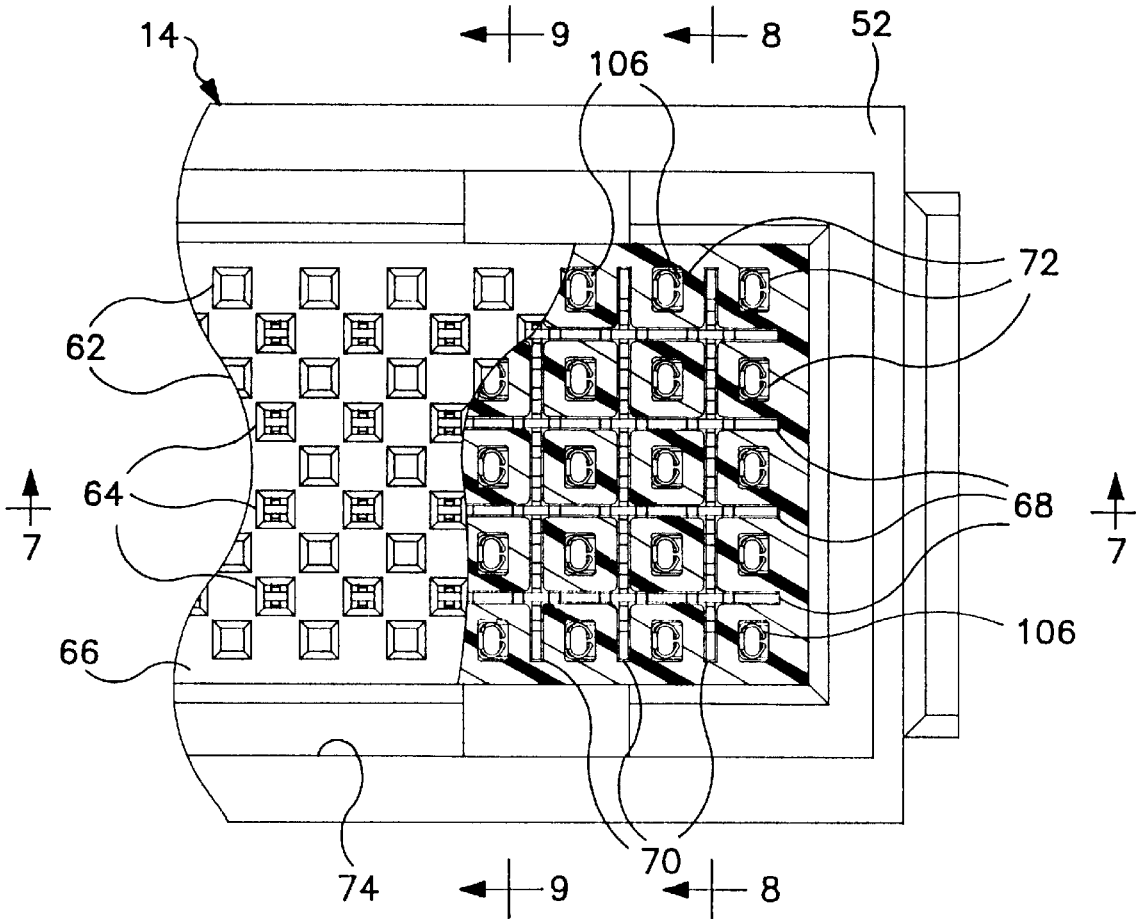
FIG. 6 is an enlarged, partially broken away, view of a portion of FIG. 5.

Longitudinal rows of signal pin openings 62 and ground pin openings 64 are formed in the lower surface 66 of body 52. The ground pin openings 64 are each located equidistant from the four adjacent signal pin openings 62, corresponding to the locations of ground pins 24 with regard to signal pins 22 in contact housing 12. Longitudinal slots 68 extend along the length of body 52 above openings 64. Lateral slots 70 extend across the width of body 52 above lateral rows of openings 64 and intersect slots 68 above the ground pin openings 64. Disconnect terminal recesses 72 are formed in body 52 above signal pin openings 62. As illustrated in FIG. 6 cavity terminal recesses 72 are surrounded, or partially surrounded, by slots 68 and 70. Rectangular circumferential recess 74 extends around the circumference of housing 14 and surrounds slots 68 and 70 and cavities 72. When housings 12 and 14 are mated wall 50 extends into recess 74, as illustrated in FIGS. 10 and 11.

Figure 5:
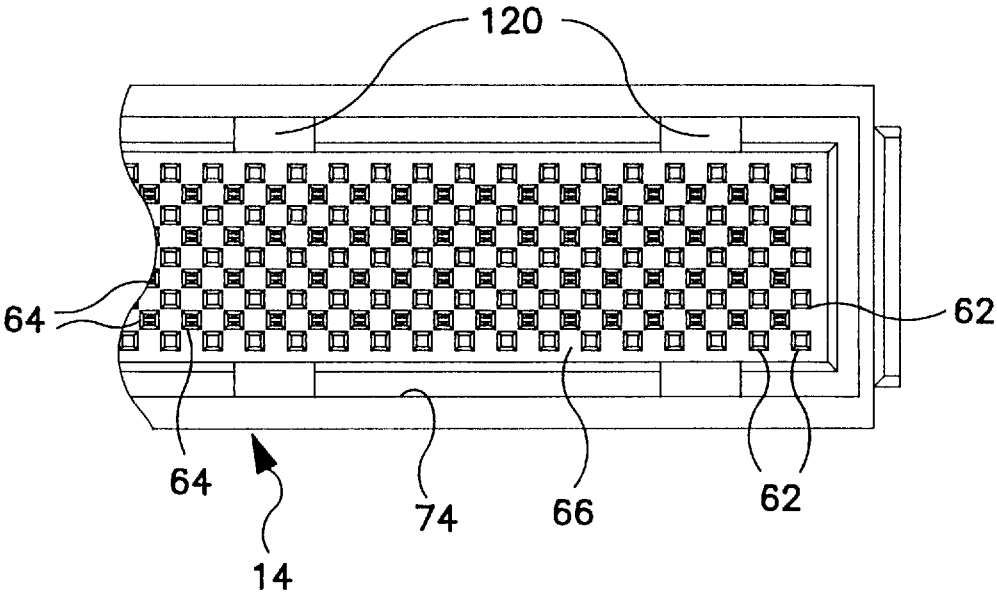

Rectangular spacer plate 54 overlies body 52 and includes a plurality of signal tail opening 76 and a plurality of ground tail openings 78. Each signal tail opening 76 is located above a signal pin opening 62 in body 52. Each ground tail opening 68 is located above a ground pin opening 64 in body 52. Cavities 72 communicate openings 62 and 76. The intersections of slots 68 and 70 communicate openings 64 and 78. The openings 76 and 78 in plate 54 are arranged in longitudinal spaced rows arranged in the same pattern of the openings 62 and 64 shown in FIG. 5. Spacer plate 54 includes shallow lateral slots 80 overlying slots 70 in body 52 and shallow longitudinal slots 82 overlying longitudinal slots 68. The plate 54 rests flush on the top of body 52.

Figure 12:
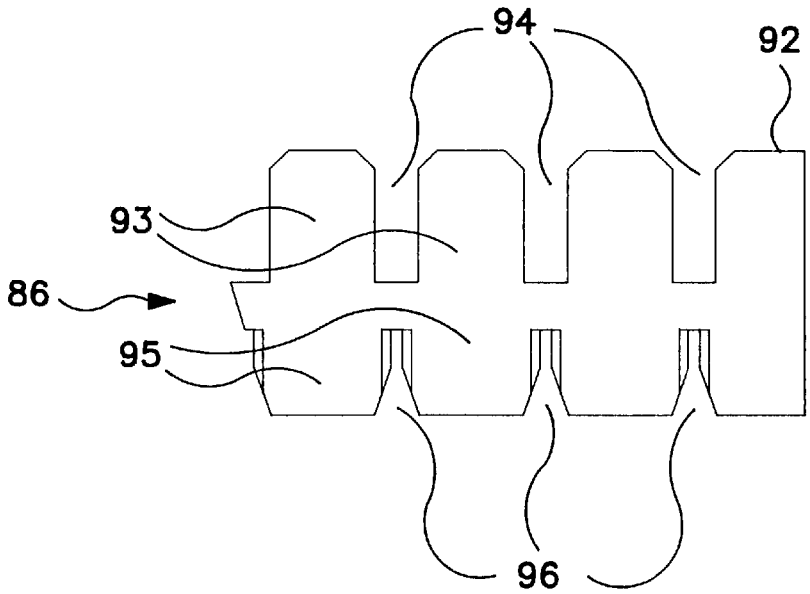
FIGS. 12 and 13 illustrate ground blades used in the block.
Figure 13:
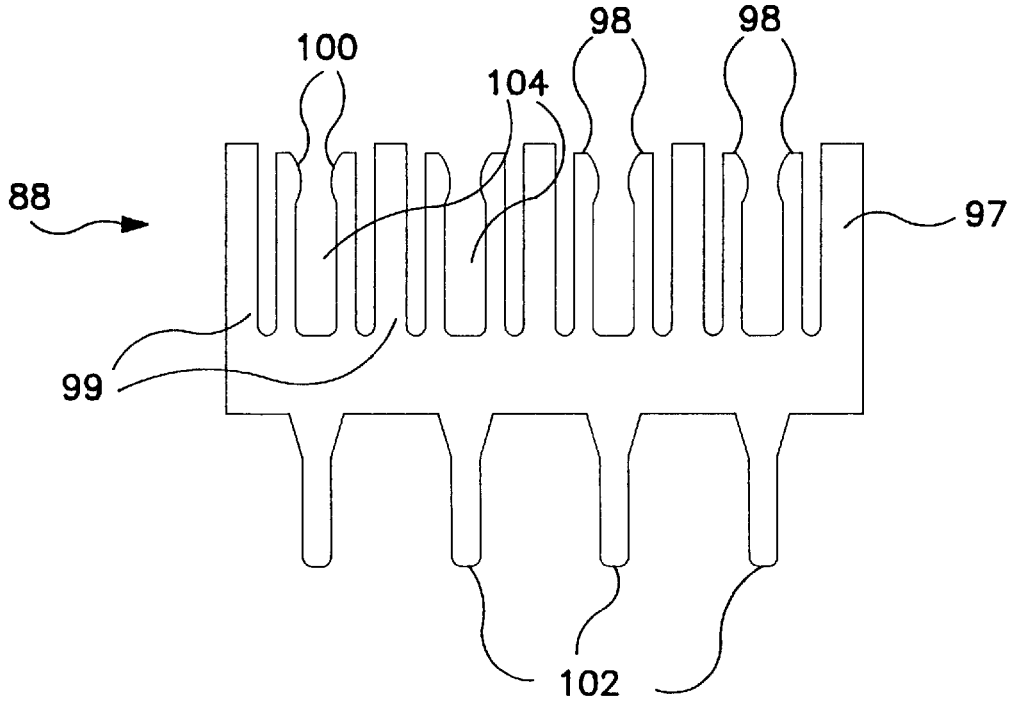

FIGS. 12 and 13 illustrate ground blades 86 and 88 which are assembled to form an orthogonal ground plane matrix 90 fitted in the slots in body 52. Each longitudinal blade 86 is formed from a uniform thickness conductive metal strip 92 with spaced ground pin slots 94 extending into one side of the strip between shields 93 and spaced narrow press fit slots 96 extending into the other side of the strip, across from slots 94, between shields 95.

Each lateral ground blade 88 is formed from a uniform thickness conductive metal strip 97 and includes pairs of cantilever contact arms 98 spaced along the one side of the strip between shields 99. Each pair of contact arms includes inwardly facing convex contact faces 100 at the ends of the arms. Tails 102 are located along the length of the strip across form the contact arms. Tails 102 extend away from the strip.

Figure 14:
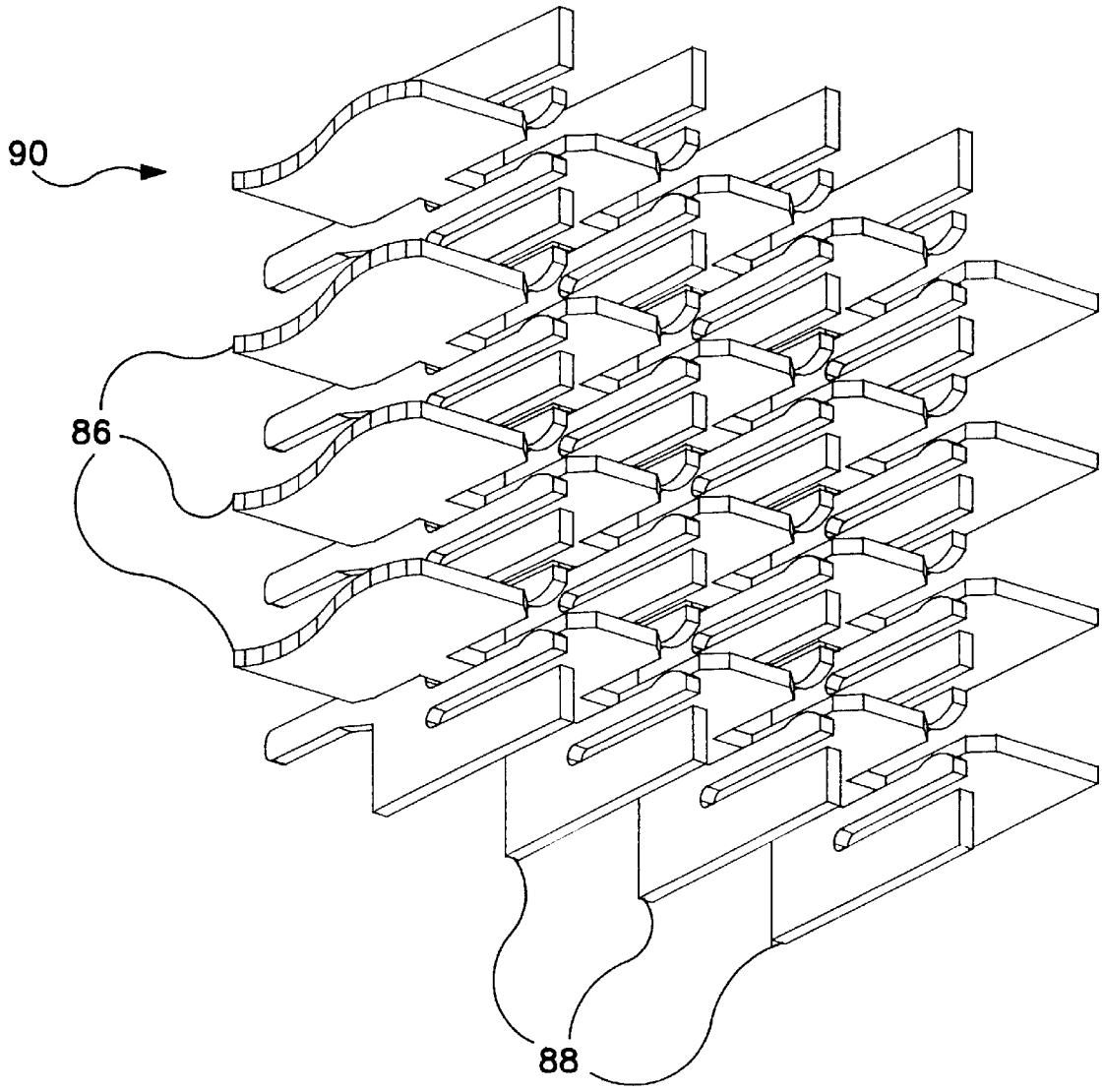
FIG. 14 is a perspective view of the ground plane matrix.

Sets of blades 86 and 88 are assembled to form the ground plane matrix 90 shown in FIG. 14. The matrix includes a number of parallel spaced strips 86 which extend longitudinally across a number of parallel spaced lateral strips 88. The lower sides of strips 86, as shown in FIG. 12, are fitted in slots 104 between the contact arms 98 and then are pressed down onto strip 97 to form reliable press-fit electrical ground connections between the intersecting blades in the matrix. The matrix is fitted in body 52 with blades 86 fitted in slots 68 and 82, blades 88 fitted in slots 70 and 80 and ground contact tails 102 extending above plate 54 through openings 78. With the matrix in place, each pair of contact arms 98 is located to either side of a ground pin opening 64 in lower surface 66 with slots 94 in blades 86 located over openings 64 to permit insertion of ground contact pins 24 into the openings and formation of ground electrical connections between the pins and the blades in the matrix. See FIGS. 7, 8 and 10. In practice, matrix 90 may be formed during assembly of contact housing 14 by first positioning longitudinal blades 86 in slots 68 and then pressing the lateral blades down over the longitudinal blades and into slots 70 to form reliable electrical connections between the blades 86 and 88 in the matrix.

Female disconnect terminals 106 are positioned in terminal cavities 72 for establishing electrical connections with signal contact pins 22 extended into the cavities through openings 62. The terminals 106 may be of the type disclosed in U.S. Pat. No. 4,865,567, the disclosure of which is incorporated herein by reference. Terminals 106 include signal contact tails 108 which extend upwardly from cavity 74 through openings 76.

After the matrix 90 and terminals 106 have been placed in body 52, spacer plate 54 is positioned over the ground and signal tails 102 and 108 and the pre-punched end of flexible cable 18 is positioned over the tails. Suitable electrical connections are formed between individual signal lines in the cable and individual signal tails 108. Similar connections are formed between the individual ground lines in the cable and the ground tails 102, thereby forming a ground connection between the matrix 90 and each of the ground lines in the cable. As illustrated, the cable end is supported on spacers 84.

Figure 7:
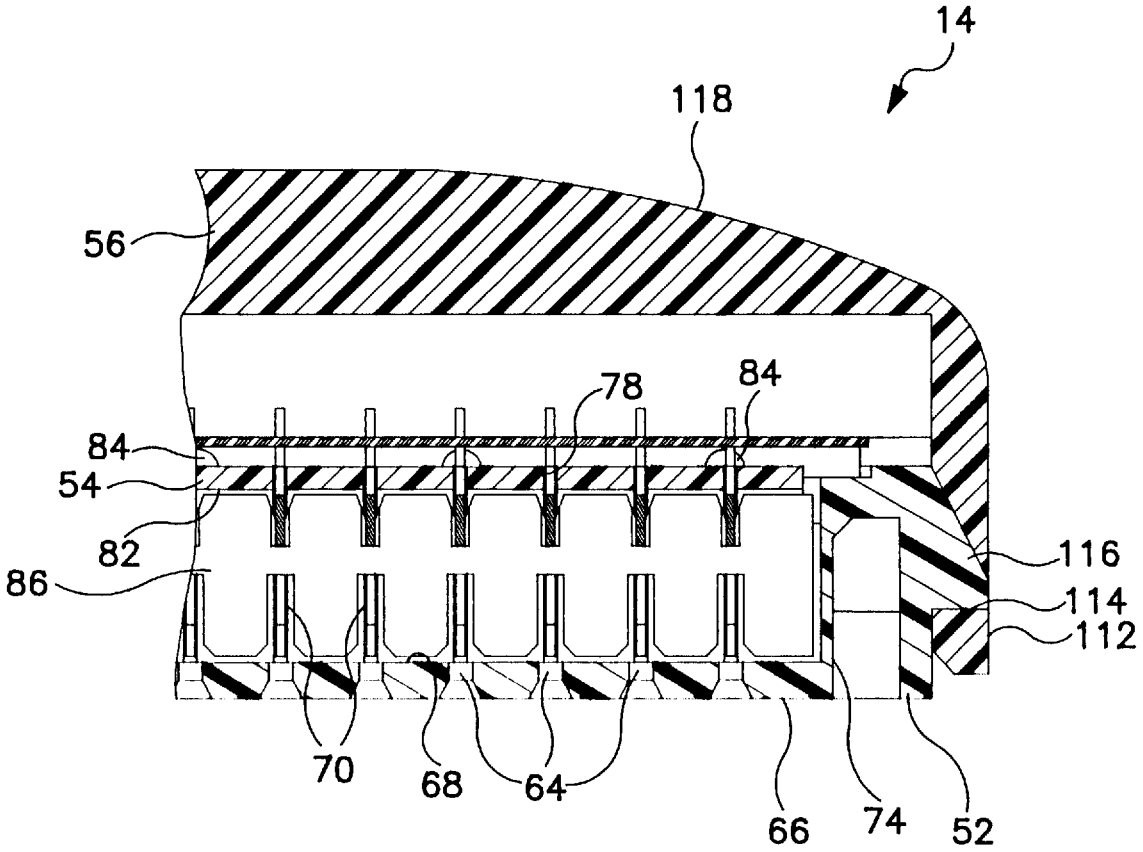
FIGS. 7, 8 and 9 are sectional views taken along lines 7—7, 8—8 and 9—9 respectively of FIG. 6.
Figure 8:
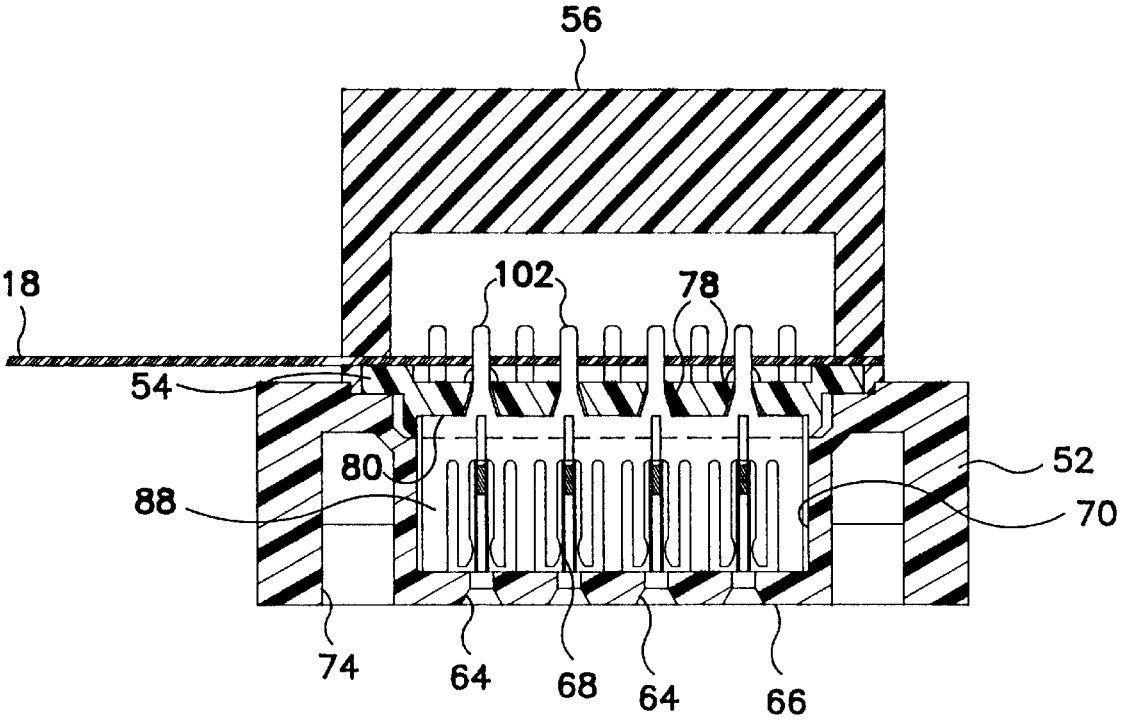
Figure 9:
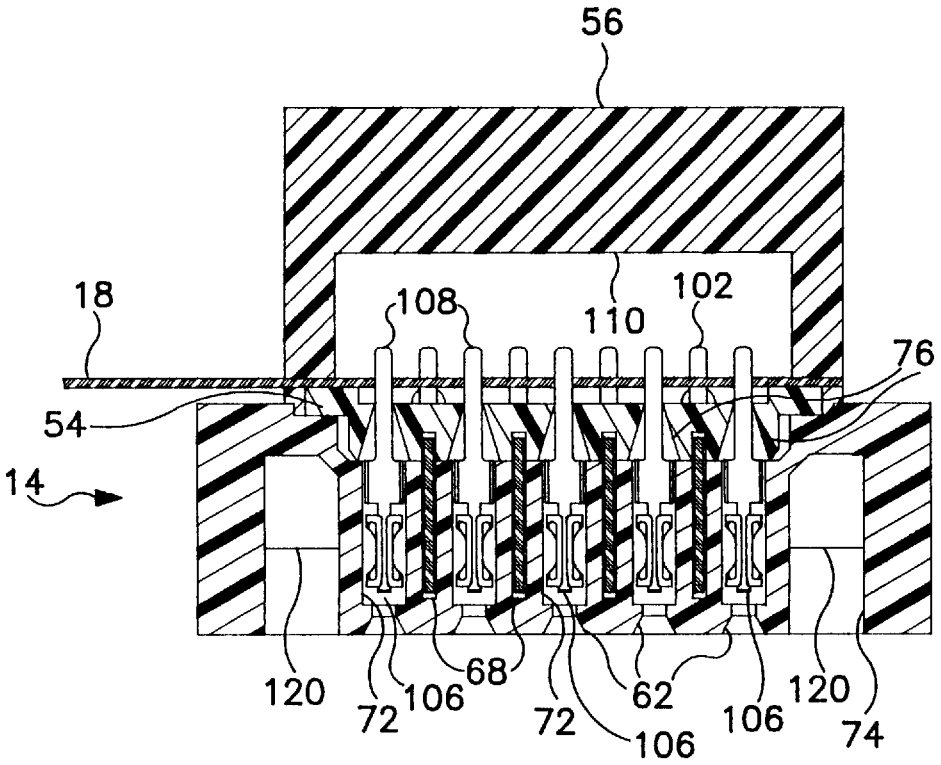

Stress relief cover 56 is mounted on the top of body 52 and clamps the end of the cable against the body. Tails 102 and 108 extend freely into central recess 110 in the cover. Flexible latch arms 112 on the ends of the cover 56 are provided with latch openings 114. The cover is preferably molded from stiffly flexible plastic material which permits positioning the cover on the top of the fully assembled body 52 with attached cable 18 and then pressing the cover toward the body to flex arms 112 over latch projections 116. The projections 116 have upwardly facing sloped cam surfaces which flex arms 112 outwardly until the arms pass the projections and snap in place to hold the cover tightly on the body as illustrated in FIG. 7.

Each end of the cover is provided with a convex, upwardly sloping cam surface 118 extending inwardly from the end of the cover to a central flat top surface 119. The slope (rise over run) of each surface 118 decreases in value inwardly from the end of the cover to the top.

The base contact housing 14 is mounted on circuit board 16 and electrical connections are formed between the signal and ground contact pin tails 26 and signal and ground circuits in the board. The header contact housing is mated with the base contact housing by positioning housing 14 over the base contact housing 12 with the arms 28 spread apart in the open position, as shown in FIG. 2. Housing 14 is then lowered onto housing 12 and the upper ends of signal contact pins 22 and ground contact pins 24 piloted into signal pin openings 62 and ground pin openings 64, respectively, in body 52. Proper positioning of the two housings is facilitated by fitting wall 50 in recess 74 prior to fitting the pins in the openings. Proper alignment is further facilitated by positioning alignment projections 120 in the bottom of recess 74 in cutouts 122 formed in wall 50.

With the contact housing properly positioned on base housing 12 the two housings are mated by rotating the outer ends 34 of arms 28 inwardly toward each other. Inward rotation of the arms brings rollers 46 into engagement with the cam surfaces 118. Initial inward rotation of the arms moves the low friction rollers 46 inwardly along the surfaces to move the housings together toward the fully mated position relatively rapidly. After initial movement of housing 14 toward housing 12 the force required to mate the two housing increases greatly as the large number of signal pins 22 are moved into and deform the disconnect terminals 106 and the large number of ground contact pins 24 are moved between and deform the pairs of contact arms 98. At this time, the rollers 46 have moved inwardly along surfaces 118 to lower slope portions, permitting continued closure, although at a slower rate, without increasing the torque required to rotate the arms.

The fully mated housing shown in FIG. 3 may be separated or unmated by grasping the ends of the arms 28 and moving the ends outwardly, thereby rotating ejection fingers 42 up against surface 66 and separating the two housings.

When the housings 12 and 14 are mated the high speed signal transmission lines from cable 18 to circuit board 16 are effectively shielded from each other by the ground plane matrix 90 and the ground contact pins 24. Shielding by the matrix and pins controls the impedance between the cable and circuit board to permit high speed transmission of signals between the cable and board through signal contact pins 20 and disconnect terminals 106.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A connector block comprising,

A) a first housing having a first insulating body, a plurality of first signal contact members in the first body, said signal contact members arranged in spaced parallel rows extending along the first body, and a plurality of ground contact members in the first body, said ground contact members arranged in spaced parallel rows extending along the first body, the rows of ground contact members located between the rows of signal contact members;

B) a second housing having a second insulating body overlying the first insulating body, a plurality of second signal contact members in the second body, said second signal contact members arranged in spaced parallel rows extending along the second body and engaging the first signal contact members to form signal electrical connections extending through the block; and C) a ground plane matrix in the block, said matrix including a first set of parallel ground blades located between rows of signal contact members and a second set of parallel ground blades extending across said rows of signal contact members such that the sets of blades cross each other at points of intersection, electrical connections between said sets of ground blades at said points of intersection, and a ground contact member located within the thickness of a blade at each point of intersection for forming electrical connections with said ground contact members.

2. A connector block as in claim 1 wherein each ground contact member comprises a spring and a contact surface on the spring.

3. A connector block as in claim 2 wherein each spring includes a cantilever arm and the contact surface is on the free end of the arm.

4. A connector block as in claim 1 wherein at each intersection the ground plane matrix includes a pair of cantilever contact arms, said arms each located in the thickness of a blade.

5. A connector block as in claim 4 wherein each blade includes a slot at each intersection.

6. A connector block as in claim 5 wherein each blade includes shields located between adjacent slots.

7. A connector block as in claim 1 wherein one set of ground blades extends through said slots in the other set of ground blades.

8. A connector block as in claim 1 wherein said first body includes a pair of body members overlying each other, slots in said body members, and wherein said matrix blades are fitted in said slots.

9. A connector block as in claim 1 wherein said second housing includes a convex, upwardly sloping cam surface adjacent an end of such housing, and including a mating and ejection arm rotatably mounted on said first housing, said arm comprising a closing roller engageable with said surface.

10. A connector block as in claim 9 wherein the roller is located in a recess in the arm, said recess facing the cam surface.

11. A connector block as in claim 9 including a detent in said first housing engageable with the arm to hold the roller away from the second housing.

12. A connector block comprising a pair of mated housings, a plurality of mated signal contact members, a plurality of ground pins, and a ground plane matrix, the ground plane matrix including a plurality of spaced, parallel first ground blades formed from strip metal, a plurality of spaced, parallel second ground blades formed from strip metal, said second ground blades extending generally perpendicularly to said first ground blades and crossing said first ground blades at points of intersection, electrical connections between said blades at said points of intersection, and a contact member formed in the thickness of one of said blades at each point of intersection, said contact members each engaging one of said ground pins, said ground plane matrix blades extending between adjacent contact members.

13. A connector block as in claim 12 wherein the blades are formed from uniform thickness strip metal, each blade including a ground pin slot at each intersection, and a pair of opposed ground pin contacts formed in the thickness of a blade at each intersection.

14. A connector block as in claim 13 wherein each of said first blades extends through ground pin slots formed in said second blades.

15. A connector block as in claim 14 wherein said ground pin contacts comprise contact arms.

16. A connector block as in claim 15 wherein said contacts are located on the ends of cantilever arms.

17. A connector block as in claim 13 including shields located on each blade between adjacent pairs of ground pin slots.

18. A connector block as in claim 12 including press fit slots formed in said first blades at said intersections, said second blades fitted in said slots.

19. A connector block as in claim 12 wherein said ground plane matrix is located in one of said housings.

20. A connector block as in claim 19 wherein said one housing includes an insulating body, an insulating plate overlying the body, grooves formed in said body and plate, said blades in the matrix fitted in into said grooves.

* * * * *

UNITED STATES PATENT AND TRADEMARK OFFICE

CERTIFICATE OF CORRECTION

PATENT NO. : 5,882,227

DATED : March 16, 1999

INVENTOR(S) : Douglas A. Neidich

It is certified that error appears in the above-identified patent and that said Letters Patent is hereby corrected as shown below:

Claim 20, line 4, after "fitted in" delete "into".

Signed and Sealed this

Twentieth Day of July, 1999

*Attest:*

*Attesting Officer*

Q. TODD DICKINSON

*Acting Commissioner of Patents and Trademarks*